US007183026B2

(12) United States Patent
Zhu et al.

(10) Patent No.: US 7,183,026 B2
(45) Date of Patent: Feb. 27, 2007

(54) ORGANOPHOTORECEPTOR WITH A PLURALITY OF PHOTOCONDUCTIVE LAYERS

(75) Inventors: Jiayi Zhu, Woodbury, MN (US); Ronald J. Moudry, Woodbury, MN (US)

(73) Assignee: Samsung Electronics Co., Ltd., Suwon (KR)

( * ) Notice: Subject to any disclaimer, the term of this patent is extended or adjusted under 35 U.S.C. 154(b) by 55 days.

(21) Appl. No.: 10/453,347

(22) Filed: Jun. 3, 2003

(65) Prior Publication Data

US 2004/0043313 A1 Mar. 4, 2004

Related U.S. Application Data

(60) Provisional application No. 60/407,271, filed on Aug. 30, 2002.

(51) Int. Cl.
*G03G 5/06* (2006.01)

(52) U.S. Cl. ..... 430/57.2; 430/56; 430/57.3; 430/970; 399/159

(58) Field of Classification Search ..... 430/56, 430/57.2, 57.3, 970; 399/159
See application file for complete search history.

(56) References Cited

U.S. PATENT DOCUMENTS

| | | | | |
|---|---|---|---|---|
| 5,213,927 | A * | 5/1993 | Kan et al. | 430/57.2 |
| 5,328,788 | A * | 7/1994 | Omote et al. | 430/57.3 |
| 5,476,740 | A * | 12/1995 | Markovics et al. | 430/57.3 |
| 5,882,830 | A | 3/1999 | Visser et al. | |
| 6,020,097 | A | 2/2000 | Visser et al. | |
| 6,027,844 | A | 2/2000 | Nguyen et al. | |
| 6,156,466 | A * | 12/2000 | Tamura et al. | 430/57.3 |
| 6,348,290 | B1 * | 2/2002 | Yokota | 430/57.3 |
| 6,586,148 | B1 | 7/2003 | Graham et al. | |
| 2003/0224268 | A1 * | 12/2003 | Ikuno et al. | 430/57.3 |
| 2004/0063011 | A1 * | 4/2004 | Lin et al. | 430/57.3 |

FOREIGN PATENT DOCUMENTS

| | | | |
|---|---|---|---|
| EP | 366634 | A2 * | 5/1990 |
| JP | 07128872 | A * | 5/1995 |
| JP | 07253679 | | 10/1995 |

OTHER PUBLICATIONS

Borsenberger, Paul M. et al. Organic Photoreceptors for Imaging Systems. New York: Marcel-Dekker, Inc. (1993) pp. 6-10.*

* cited by examiner

*Primary Examiner*—Christopher Rodee
(74) *Attorney, Agent, or Firm*—Patterson, Thuente, Skaar & Christensen, P.A.

(57) ABSTRACT

This invention relates to an improved organophotoreceptor that comprises an electrically conductive substrate having at least a surface; an inner photoconductive layer adjacent the surface of the electrically conductive substrate; and an outer photoconductive layer adjacent the inner photoconductive layer. In some embodiments, the inner photoconductive layer comprises a first binder in an amount not more than 45% by weight of the inner photoconductive layer, a first charge generating compound, and a charge transport compound, and the outer photoconductive layer comprises a second binder in an amount not less than 45% by weight of the outer photoconductive layer and a second charge generating compound. The inner photoconductive layer and the outer photoconductive layer can be discrete layers or sections of a gradient layer.

17 Claims, 2 Drawing Sheets

ORGANOPHOTORECEPTOR WITH A PLURALITY OF PHOTOCONDUCTIVE LAYERS

CROSS REFERENCE TO RELATED APPLICATIONS

This application claims priority to copending U.S. Provisional Patent Application Ser. No. 60/407,271 filed on Aug. 30, 2002 to Zhu et al., entitled "Organophotoreceptor With Two Single Photoconductive Layers," incorporated herein by reference.

FIELD OF THE INVENTION

This invention relates to organophotoreceptors suitable for use in electrophotography and, more specifically, to an organophotoreceptor having a plurality of photoconductive layers, such as an outer photoconductive layer and an inner photoconductive layer, wherein the outer photoconductive layer and the inner photoconductive layer are different in composition.

BACKGROUND OF THE INVENTION

In electrophotography, an organophotoreceptor in the form of a plate, disk, sheet, belt, drum or the like having an electrically insulating photoconductive element on an electrically conductive substrate is imaged by first uniformly electrostatically charging the surface of a photoconductive element, and then exposing the charged surface to a pattern of light. The light exposure selectively dissipates the charge in the illuminated areas where light strikes the surface, thereby forming a pattern of charged and uncharged areas, referred to as a latent image. A liquid toner or solid toner can then be provided in the vicinity of the latent image, and toner droplets or particles can be deposited in either the charged or uncharged areas, depending on the properties of the toner, to create a toned image on the surface of the photoconductive element. The resulting toned image can be transferred to a suitable ultimate or intermediate receiving surface, such as paper, or the photoconductive element can operate as the ultimate receptor for the image. The imaging process can be repeated many times to complete a single image, which can involve, for example, overlying images of distinct color components or effecting shadow images to complete a full color complete image, and/or to reproduce additional images.

Both single layer and multilayer photoconductive elements have been used. In the single layer embodiment, a charge generating compound and a charge transport material selected from the group consisting of a charge transport compound, an electron transport compound, and a combination of both are combined with a polymeric binder and then deposited on the electrically conductive substrate. In the multilayer embodiments based on a charge transport compound, a charge transport compound and a charge generating compound are in the form of separate layers, each of which can optionally be combined with a polymeric binder, deposited on the electrically conductive substrate. Two arrangements are possible. In one arrangement (the "dual layer" arrangement), the charge generating layer is deposited on the electrically conductive substrate and the charge transport layer is deposited on top of the charge generating layer. In an alternate arrangement (the "inverted dual layer" arrangement), the order of the charge transport layer and charge generating layer is reversed.

In both the single and multilayer photoconductive elements, the purpose of the charge generating material is to generate charge carriers (i.e., holes and/or electrons) upon exposure to light. The purpose of the charge transport material is to accept these charge carriers and transport them through the charge transport layer in order to discharge a surface charge on the photoconductive element. The charge transport material can be a charge transport compound, an electron transport compound, or a combination of both. When a charge transport compound is used, the charge transport compound accepts the hole carriers and transports them through the layer in which the charge transport compound is located. When an electron transport compound is used, the electron transport compound accepts the electron carriers and transports them through the layer in which the electron transport compound is located.

SUMMARY OF THE INVENTION

This invention provides novel organophotoreceptors having both good electrostatic properties (such as high $V_{acc}$ and low $V_{dis}$) and high chemical, solvent, and abrasion resistances.

In a first aspect, the invention features an organophotoreceptor comprising an electrically conductive substrate having a surface; a discrete inner photoconductive layer adjacent said surface; and a discrete outer photoconductive layer adjacent said inner photoconductive layer with the inner photoconductive layer between the outer photoconductive layer and said electrically conductive substrate. The composition of said inner photoconductive layer is different from the composition of said outer conductive layer. In some embodiments, the inner photoconductive layer comprises a first binder in an amount not more than 45% by weight of the inner photoconductive layer, a first charge generating compound, and a charge transport compound, and the outer photoconductive layer comprises a second binder in an amount not less than 45% by weight of the outer photoconductive layer and a second charge generating compound.

In a second aspect, the invention features an electrophotographic imaging apparatus that includes (a) a plurality of support rollers; and (b) the above-described organophotoreceptor in the form of a flexible belt threaded around the support rollers. The apparatus preferably further includes a toner dispenser. In some embodiments, the inner photoconductive layer and the outer photoconductive layer can be a portion of a gradient layer.

In a third aspect, the invention features an electrophotographic imaging process that includes (a) applying an electrical charge to a surface of the above-described organophotoreceptor; (b) imagewise exposing the surface of the organophotoreceptor to radiation to dissipate charge in selected areas and thereby form a pattern of charged and uncharged areas on the surface; (c) contacting the surface with a toner to create a toned image; and (d) transferring the toned image to a substrate. In some embodiments, the inner photoconductive layer and the outer photoconductive layer can be a portion of a gradient layer.

In another aspect, the invention features an organophotoreceptor comprising an electrically conductive substrate having a surface and a photoconductive layer adjacent the surface. In these embodiments, the photoconductive layer has a composition gradient.

DETAILED DESCRIPTION OF PREFERRED EMBODIMENTS

Figure 1:
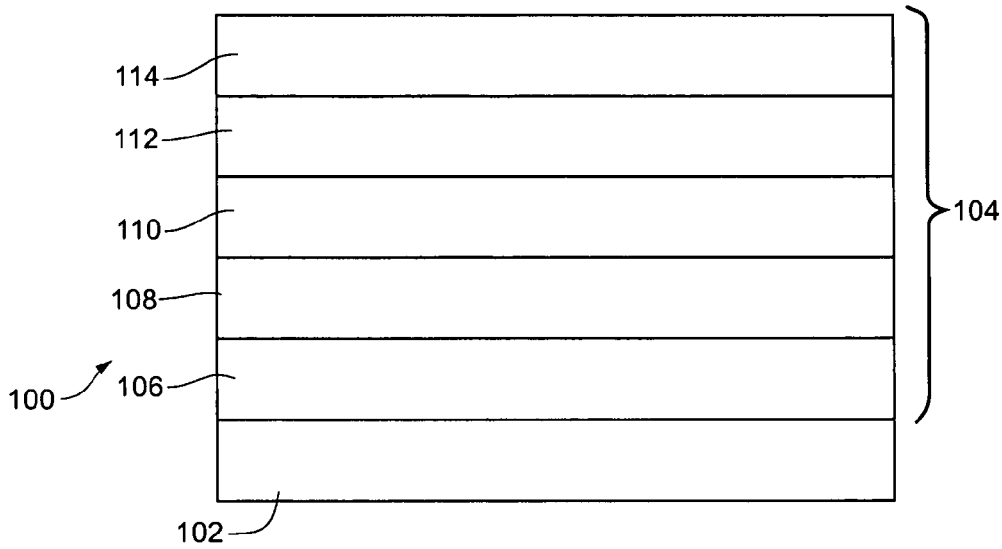
FIG. 1 is a schematic side view of an organophotoreceptor comprising two photoconductive layers.

Improved organophotoreceptors comprise two or more photoconductive layers having different compositions from each other in which each photoconductive layer comprises a charge generating compound. Generally, each photoconductive layer can optionally further comprise a polymeric binder, a charge transport compound, an electron transport compound and/or a UV light stabilizer. In general, the organophotoreceptor comprises an electrically conductive substrate having a photoconductive element on a surface of the electrically conductive substrate in which the photoconductive element having a plurality of layers of differing composition within its structure including the plurality of photoconductive layers. In some embodiments, the organophotoreceptors can comprise a large number of photoconductive layers with a gradually varying composition, which becomes a gradient in the limit of increasingly thin layers. The term a "discrete layer" distinguishes clearly identifiable layers with an approximately uniform average composition from layers forming a portion of a gradient layer, as described further below. As described herein for convenience, a layer with a composition gradient can be considered as having a plurality of layers with an arbitrarily small thickness with slightly varying composition from each other. Additional charge transport layers, electron transport layers, underlayers and overlayers can be included within the organophotoreceptor.

To produce high quality images, particularly after multiple cycles, it can be desirable to increase the amount of charge that the organophotoreceptor can accept (indicated by a parameter known as the acceptance voltage or "$V_{acc}$"), and to reduce retention of that charge upon discharge (indicated by a parameter known as the discharge voltage or "$V_{dis}$"). Thus, it may be correspondingly desirable to increase the amount of charge transport compound so that $V_{acc}$ is increased, and $V_{dis}$ is reduced. However, if the relative amount of charge transport compound in the photoconductive element is increased, the relative amounts of other components such as the binder in the photoconductive element have to be reduced. If the amount of the binder drops too low, the chemical, solvent, and abrasion resistances of the photoconductive element may be adversely affected. Therefore, there are difficulties in formulating organophotoreceptors, particularly single layer organophotoreceptors, having both good electrostatic properties (such as high $V_{acc}$ and low $V_{dis}$) and high chemical, solvent, and abrasion resistances.

The improved organophotoreceptors, described herein, can have a high $V_{acc}$, a low $V_{dis}$, and high stabilities with respect to cycling testing, crystallization, bending and stretching. The organophotoreceptors are particularly useful in laser printers and the like as well as photocopiers, scanners and other electronic devices based on electrophotography. The use of these organophotoreceptors is described in more detail below in the context of laser printer use, although their application in other devices operating by electrophotography can be generalized from the discussion below. To produce high quality images, particularly after multiple cycles, it generally is desirable for the compounds of the organophotoreceptor to form a homogeneous solution with the polymeric binder and remain approximately homogeneously distributed through the organophotoreceptor material during the cycling of the material.

In electrophotography applications, a charge generating compound within an organophotoreceptor absorbs light to form electron-hole pairs. The electron and/or hole can be transported over an appropriate time frame under a large electric field to discharge locally a surface charge that is generating the field. Electron transport compounds have an appropriate ability to transport electrons, in contrast with charge transport compounds, which are generally more effective at transporting holes, i.e., positive charges. The discharge of the field at a particular location results in a surface charge pattern that essentially matches the pattern drawn with the light. This charge pattern then can be used to guide toner deposition. To print a two dimensional image using the organophotoreceptor, the organophotoreceptor has a two dimensional surface for forming at least a portion of the image. The imaging process then continues by cycling the organophotoreceptor to complete the formation of the entire image and/or for the processing of subsequent images.

The organophotoreceptor may be provided in the form of a plate, a flexible belt, a disk, a rigid drum, a sheet around a rigid or compliant drum, or the like. The charge transport compound and/or the electron transport compound can be in the same layer as the charge generating compound and/or in a different layer from the charge generating compound. For example, the electron transport compound may be in an overcoat layer.

In the present context, layers with a charge generating compound are referred to as photoconductive layers since the layers generate charge carriers, i.e., electrons and holes, upon adsorbing light. To facilitate movement of the charge (electrons and/or holes), each of the photoconductive layers may or may not further comprise a charge transport compound and/or an electron transport compound. Similarly, the organophotoreceptor can further comprise layers with a charge transport compound and/or an electron transport compound without a charge generating compound. As described further below, additional undercoat and overcoat layers can also be used.

The organophotoreceptors can be incorporated into an electrophotographic imaging apparatus, such as laser printers. In these devices, an image is formed from physical embodiments and converted to a light image that is scanned onto the organophotoreceptor to form a surface latent image. The surface latent image can be used to attract toner onto the surface of the organophotoreceptor, in which the toner image is the same or the negative of the light image projected onto the organophotoreceptor. The toner can be a liquid toner or a dry toner. The toner can be subsequently transferred, from the surface of the organophotoreceptor, to a receiving surface, such as a sheet of paper. After the transfer of the toner, the entire surface is discharged, and the material is ready to cycle again. The imaging apparatus can further comprise, for example, a plurality of support rollers for transporting a paper receiving medium and/or for movement of the photoreceptor, a light imaging component with suitable optics to form the light image, a light source, such as a laser, a toner source and delivery system and an appropriate control system.

An electrophotographic imaging process generally can comprise (a) applying an electrical charge to a surface of the above-described organophotoreceptor; (b) imagewise exposing the surface of the organophotoreceptor to radiation to dissipate charge in selected areas and thereby form a pattern of charged and uncharged areas on the surface; (c) exposing the surface with a toner, such as a liquid toner that includes a dispersion of colorant particles in an organic liquid to create a toner image, to attract toner to the charged or discharged regions of the organophotoreceptor; and (d) transferring the toner image to a substrate.

In describing chemicals by structural formulae and group definitions, certain terms are used in a nomenclature format that is chemically acceptable. The terms "group," "moiety," and "derivatives" can have particular meanings. The term "group" indicates that the generically recited chemical material (e.g., alkyl group, phenyl group, fluorenylidene malonitrile group, carbazole hydrazone group, etc.) may have any substituent thereon which is consistent with the bond structure of that group. Thus, the term 'group' allows for the presence of further substitution on the named class of materials, as long as the substituent is still recognizable as within the generic class. For example, alkyl group includes, for example, unsubstituted liner, branched and cyclic alkyls, such as methyl, ethyl, isopropyl, tert-butyl, cyclohexyl, dodecyl and the like, and also includes such substituted alkyls such as chloromethyl, dibromoethyl, 1,3-dicyanopropyl, 1,3,5-trihydroxyhexyl, 1,3,5-trifluorocyclohexyl, 1-methoxy-dodecyl, phenylpropyl and the like. However, as is consistent with such nomenclature, no substitution would be included within the term that would alter the fundamental bond structure of the underlying group. For example, where a phenyl ring group is recited, substitution such as 1-hydroxyphenyl, 2,4-fluorophenyl, orthocyanophenyl, 1,3,5-trimethoxyphenyl and the like would be acceptable within the terminology, while substitution of 1,1,2,2,3,3-hexamethylphenyl would not be acceptable as that substitution would require the ring bond structure of the phenyl group to be altered to a non-aromatic form because of the substitution. Where the term moiety is used, such as alkyl moiety or phenyl moiety, that terminology indicates that the chemical material is not substituted. For example, the term alkyl moiety represents only an unsubstituted alkyl hydrocarbon group, whether branched, straight chain, or cyclic. Where the term derivative is used, that terminology indicates that a compound is derived or obtained from another and containing essential elements of the parent substance.

Organophotoreceptors

The organophotoreceptor may be, for example, in the form of a plate, a flexible belt, a disk, a rigid drum, or a sheet around a rigid or compliant drum, with flexible belts and rigid drums generally being used in commercial embodiments. The organophotoreceptor may comprise, for example, an electrically conductive substrate and a photoconductive element in the form of a plurality of layers. In embodiments of particular interest, the photoconductive element comprises at least two photoconductive layers with different compositions with each layer comprising a charge generating compound generally in a polymeric binder. In some embodiments, a photoconductive layer has a gradient in composition such that it is the functional equivalent of a large number of photoconductive layers with a gradual change in composition. Each photoconductive layer generates charge carriers upon exposure to light of an appropriate wavelength.

The photoconductive element generally further comprises a charge transport compound and/or an electron transport compound, which may or may not be in the same layer if both are present. Similarly, the charge generating compound and/or the electron transport compound may or may not be in one or more of the photoconductive layers with the charge generating compound. If a charge transport compound and/or an electron transport compound are in layers that do not include a charge generating compound, the layer can be referred to as a conductive layer. A conductive layer can be on top of the photoconductive layers, under the photoconductive layers and/or between photoconductive layers. Other optional overcoat, undercoat or interspersed layers between photoconductive layers can be used in some embodiments, as described further below.

The structure of an embodiment of the organophotoreceptor is shown schematically in FIG. 1. Referring to FIG. 1, organophotoreceptor 100 comprises an electrically conductive substrate 102 and a photoconductive element 104 generally comprising a plurality of discrete layers. Generally, each layer of the photoconductive element comprises a polymeric binder. As shown in FIG. 1, photoconductive element 104 comprises an optional undercoat 106, an inner photoconductive layer 108, an optional intermediate layer 110, an outer photoconductive layer 112 and an optional overcoat layer 114. A photoconductive element 104 can comprise additional photoconductive layers, including for example, one additional photoconductive layer, two additional photoconductive layers or more additional photoconductive layers. Furthermore, optional undercoat layer 106, intermediate layer 110 and overcoat layer 114, if present, can each comprise one or a plurality of physical layers. Each of the physical layers of undercoat layer 106, intermediate layer 110 and overcoat layer 114 may or may not be a conductive layer. A layer is distinguished from other distinct layers by a change in composition, which can be a concentration difference and/or substitution of different chemical compositions for other chemical compositions.

Figure 2:
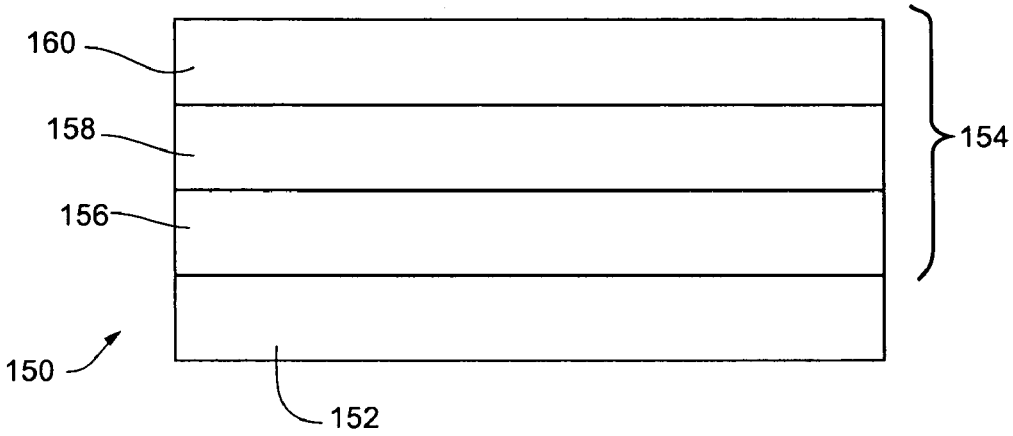
FIG. 2 is a schematic side view of an organophotoreceptor comprising a photoconductive layer with a gradient in composition, which can be interpreted as a plurality of layers with arbitrarily small thicknesses.

Another embodiment is shown in FIG. 2. In this embodiment, organophotoreceptor 150 comprises an electrically conductive substrate 152 and a photoconductive element 154. Photoconductive element 154 comprises an optional undercoat layer 156, photoconductive layer 158 and optional overcoat layer 160. In this embodiment, photoconductive layer 158 has a gradient in chemical composition. Optional undercoat layer 156 and optional overcoat layer 160 can each comprise one or a plurality of physical layers, which may or may not be conductive layers. Furthermore, photoconductive element 154 can comprise additional photoconductive layers, which can have uniform compositions, i.e., a discrete layer, or gradients in composition and can be located above and/or below photoconductive layer 158. If a plurality of photoconductive layers is used, intermediate layers can be placed between adjacent photoconductive layers. Gradient layers can be identified by an approximate monotonic variation in some aspect of the chemical composition across the thickness of a layer. For example, the concentration of a chemical composition can vary across the layer or the relative amounts of two compositions can vary across a layer.

In general, a photoconductive layer comprises a polymer binder and a charge generating compound. A photoconductive layer can optionally further comprise a charge transport compound, an electron transport compound, a UV stabilizing compound. and/or other additives Optional layers 106, 110, 114 of FIG. 1, optional layers 156, 160 of FIG. 2 and similar layers for other structures for the photoconductive element can provide for charge conduction (electrons and/or holes, i.e. positive charges) and/or physical stabilization functions, as described further below. Generally, the structure and composition of the particular layers can be selected in view of the intended use of the organophotoreceptor. For example, an organophotoreceptor can be intended for use with a positive surface charge or a negative surface charge. If used with a positive surface charge, the photoconductive element is selected to conduct electrons from a charge generating compound to the surface and holes, i.e., positive charge carriers, to the conductive substrate. If used with a negative surface charge, the photoconductive element is selected to conduct holes from a charge generating compound to the surface and electrons to the conductive substrate. In general, it is not desirable to have an intermediate layer 110, although in some embodiments intermediate layer 110 can serve useful functions, such as charge conduction or improved adherence of the layers.

In general, the photoconductive element comprises at least one charge transport compound. A charge transport compound can be in a photoconductive layer with a charge generating compound as a single layer construction. In other embodiments, however, the photoconductive element comprises a bilayer construction featuring a photoconductive layer and a separate charge transport layer. Generally, a charge transport layer is positioned to facilitate conduction of holes toward a negatively charged surface to neutralize a portion of the charge. In the structure of FIG. 1, a charge transport layer can be within undercoat layer 106, intermediate layer 110 and/or overcoat layer 114, which may or may not comprise additional layers. Similarly, in the structure of FIG. 2, a charge transport layer can be within undercoat layer 156 and/or overcoat layer 160, which may or may not comprise additional layers. Thus, a charge generating layer may be located intermediate between the electrically conductive substrate and the charge transport layer. Alternatively, the photoconductive element may have a structure in which a charge transport layer is intermediate between the electrically conductive substrate and the charge generating layer.

In some embodiments, the photoconductive element comprises an electron transport compound. If the electron transport compound is in a different layer from the charge generating compound, the electron transport compound can be an overcoat, i.e., on the side opposite the electrically conductive substrate, an undercoat, i.e., on the same side of the charge generating layer as the electrically conductive substrate, and/or in an intermediate layer between two photoconductive layers. In some embodiments, a layer with the electron transport compound further comprises an ultraviolet light stabilizer. The electron transport compound can be placed in the same layer as a charge transport compound. Similarly, a photoconductive layer can comprise an electron transport compound and/or a charge transport compound, while a separate charge transport layer and/or a separate electron transport layer can also comprise a charge transport compound or electron transport compound, respectively. In further embodiments, an electron transport layer is placed on the opposite side of a photoconductive layer from a charge transport layer, with the orientation selected to achieve appropriate flow of electrons and positive charge carriers to dissipate the surface charge in response to light at a particular location. Furthermore, the organophotoreceptor elements can further comprise additional undercoat and/or overcoat layers such as those described further below.

The electrically conductive substrate, along with an optional electrically insulating substrate, may be flexible, for example in the form of a flexible web or a belt, or inflexible, for example in the form of a drum. A drum can have a hollow cylindrical structure that provides for attachment of the drum to a drive that rotates the drum during the imaging process. Typically, the combined substrate comprises an electrically insulating substrate and a thin layer of electrically conductive material as the electrically conductive substrate onto which the photoconductive material is applied.

The electrically insulating substrate may be paper or a film forming polymer such as polyester (e.g., polyethylene terephthalate and/or polyethylene naphthalate), polyimide, polysulfone, polypropylene, nylon, polyester, polycarbonate, polyvinyl resin, polyvinyl fluoride, polystyrene, mixtures thereof and the like. Specific examples of polymers for supporting substrates include, for example, polyethersulfone (STABAR™ S-100, available from ICI), polyvinyl fluoride (TEDLAR™, available from E.I. DuPont de Nemours & Company), polybisphenol-A polycarbonate (MACROFOL™, available from Mobay Chemical Company) and amorphous polyethylene terephthalate (MELINAR™, available from ICI Americas, Inc.). The electrically conductive materials may comprise graphite, dispersed carbon black, iodide, conductive polymers such as polypyroles and CALGON™ conductive polymer 261 (commercially available from Calgon Corporation, Inc., Pittsburgh Pa.), metals such as aluminum, titanium, chromium, brass, gold, copper, palladium, nickel, or stainless steel, a metal oxide such as tin oxide or indium oxide, or combinations thereof. In embodiments of particular interest the electrically conductive material is aluminum. Generally the photoconductor substrate has a thickness adequate to provide the required mechanical stability. For example, flexible web substrates generally have a thickness from about 0.01 to about 1 mm, while drum substrates generally have a thickness from about 0.5 mm to about 2 mm.

The charge generating compound is a material, such as a dye or pigment, which is capable of absorbing light to generate charge carriers. Examples of suitable charge generating compounds include metal-free phthalocyanines (eg., CGM-X01 available from Sanyo Color Works, Ltd.), metal phthalocyanines such as titanium phthalocyanine, copper phthalocyanine, oxytitanium phthalocyanine, hydroxygallium phthalocyanine, squarylium dyes and pigments, hydroxy-substituted squarylium pigments, perylimides, polynuclear quinones available from Allied Chemical Corporation under the trade name INDOFAST™ Double Scarlet, INDOFAST™ Violet Lake B, INDOFAST™ Brilliant Scarlet and INDOFAST™ Orange, quinacridones available from DuPont under the trade name MONASTRAL™ Red, MONASTRAL™ Violet and MONASTRAL™ Red Y, naphthalene 1,4,5,8-tetracarboxylic acid derived pigments including the perinones, tetrabenzoporphyrins and tetranaphthaloporphyrins, indigo, and thioindigo dyes, benzothioxanthene-derivatives, perylene 3,4,9,10-tetracarboxylic acid derived pigments, polyazo-pigments including bisazo-, trisazo- and tetrakisazo-pigments, polymethine dyes, dyes containing quinazoline groups, tertiary amines, amorphous selenium, selenium alloys such as selenium-tellurium, selenium-tellurium-arsenic and selenium-arsenic, cadmium sulphoselenide, cadmium selenide, cadminum sulphide, and mixtures thereof. For some embodiments, the charge generating compound comprises oxytitanium phthalocyanine (e.g., any phase thereof), hydroxygallium phthalocyanine or a combination thereof.

Any suitable electron transport composition may be used in the appropriate layer or layers. Generally, the electron transport composition has an electron affinity that is large relative to potential electron traps while yielding an appropriate electron mobility in a composite with a polymer. In some embodiments, the electron transport composition has a reduction potential less than $O_2$. In general, electron transport compositions are easy to reduce and difficult to oxidize while charge transport compositions generally are easy to oxidize and difficult to reduce. In some embodiments, the electron transport compounds have a room temperature, zero field electron mobility of at least about $1\times10^{-13}$ $cm^2/Vs$, in further embodiments at least about $1\times10^{-10}$ $cm^2/Vs$, in additional embodiments at least about $1\times10^{-8}$ $cm^2/Vs$, and in other embodiments at least about $1\times10^{-6}$ $cm^2/Vs$. A person of ordinary skill in the art will recognize that other ranges of electron mobility within the explicit ranges are contemplated and are within the present disclosure.

Non-limiting examples of suitable electron transport compound include bromoaniline, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-indeno4H-indeno[1,2-b]thiophene-4-one, and 1,3,7-trinitrodibenzo thiophene-5,5-dioxide, (2,3-diphenyl-1-indenylidene)malononitrile, 4H-thiopyran-1,1-dioxide and its derivatives, such as 4-dicyanomethylene-2,6-diphenyl-4H-thiopyran-1,1-dioxide, 4-dicyanomethylene-2,6-di-m-tolyl-4H-thiopyran-1,1-dioxide, and unsymmetrically substituted 2,6-diaryl-4H-thiopyran-1,1-dioxide such as 4H-1,1-dioxo-2-(p-isopropyl phenyl)-6-phenyl-4-(dicyanomethylidene)thiopyran and 4H-1,1-dioxo-2-(p-isopropyl phenyl)-6-(2-thienyl)-4-(dicyanomethyl-idene)thiopyran, derivatives of phospha-2,5-cyclohexadiene, alkoxycarbonyl-9-fluorenylidene) malononitrile derivatives such as (4-n-butoxycarbonyl-9-fluorenylidene)malononitrile, (4-phenethoxycarbonyl-9-fluorenylidene)malononitrile, (4-carbitoxy-9-fluorenylidene)malononitrile, and diethyl (4-n-butoxycarbonyl-2,7-dinitro-9-fluorenylidene)-malonate, anthraquino dimethane derivatives such as 11,11,12,12-tetracyano-2-alkylanthraquinodimethane and 11,11-dicyano-12,12-bis(ethoxycarbonyl)anthraquinodimethane, anthrone derivatives such as 1-chloro-10-[bis(ethoxycarbonyl)methylene]anthrone, 1,8-dichloro-10-[bis(ethoxycarbonyl)methylene]anthrone, 1,8-dihydroxy-10-[bis(ethoxycarbonyl)methylene]anthrone, and 1-cyano-10-[bis(ethoxycarbonyl) methylene)anthrone, 7-nitro-2-aza-9-fluroenylidene-malononitrile, diphenoquinone derivatives, benzoquinone derivatives, naphtoquinone derivatives, quinine derivatives, tetracyanoethylenecyanoethylene, 2,4,8-trinitro thioxantone, dinitrobenzene derivatives, dinitroanthracene derivatives, dinitroacridine derivatives, nitroanthraquinone derivatives, dinitroanthraquinone derivatives, succinic anhydride, maleic anhydride, dibromo maleic anhydride, pyrene derivatives, carbazole derivatives, hydrazone derivatives, N,N-dialkylaniline derivatives, diphenylamine derivatives, triphenylamine derivatives, triphenylmethane derivatives, tetracyanoquinonedimethane, 2,4,5,7-tetranitro-9-fluorenone, 2,4,7-trinitro-9-dicyanomethylenenefluorenone, 2,4,5,7-tetranitroxanthone derivatives, 2,4,8-trinitrothioxanthone derivatives and combinations thereof.

Ultraviolet light stabilizers can be ultraviolet light absorbers or ultraviolet light inhibitors. UV light absorbers can absorb ultraviolet radiation and dissipate it as heat. UV light inhibitors are thought to trap free radicals generated by the ultraviolet light and after trapping of the free radicals, subsequently to regenerate active stabilizer moieties with energy dissipation. It has been discovered that UV stabilizers have a synergistic relationship with electron transport compounds to conduct electrons along the pathway established by the electric field in an organophotoreceptor during use. Thus, the particular advantages of the UV stabilizers are not their UV stabilizing abilities, although the UV stabilizing ability may be further advantageous in reducing degradation of the organophotoreceptor over time. While not wanting to be limited by theory, the synergistic relationship contributed by the UV stabilizers may be related to the electronic properties of the compounds, which contribute to the UV stabilizing function, further contribute to establishing electron conduction pathways in combination with the electron transport compounds. In particular, the improved organophotoreceptors demonstrate a reduced decrease of acceptance voltage $V_{acc}$ after cycling, as described further below. The synergistic relationship of a electron transport compound and a UV stabilizer are described further in copending U.S. patent application Ser. No. 10/425,333 to Zhu filed Apr. 28, 2003, entitled "Organophotoreceptor With Light Stabilizer," incorporated herein by reference. While UV stabilizers have a synergistic relationship with electron transport compounds, UV stabilizers can also be included in layers that do not have electron transport compounds.

Non-limiting examples of suitable light stabilizers include, for example, hindered trialkylamines such as TINUVIN™ 144 and TINUVIN™ 292 (from Ciba Specialty Chemicals, Terrytown, N.Y.), hindered alkoxydialkylamines such as TINUVIN™ 123 (from Ciba Specialty Chemicals), benzotriazoles such as TINUVIN™ 328, TINUVIN™ 900 and TINUVIN™ 928 (from Ciba Specialty Chemicals), benzophenones such as SANDUVOR™ 3041 (from Clariant Corp., Charlotte, N.C.), nickel compounds such as ARBESTAB™ (from Robinson Brothers Ltd, West Midlands, Great Britain), salicylates, cyanocinnamates, benzylidene malonates, benzoates oxanilides such as SANDUVOR™ VSU (from Clariant Corp., Charlotte, N.C.), triazines such as CYAGARD™ UV-1164 (from Cytec Industries Inc., N.J.), polymeric sterically hindered amines such as LUCHEM™ (from Atochem North America, Buffalo, N.Y.). In some embodiments, the light stabilizer is selected from the group consisting of hindered trialkylamines having the following formula:

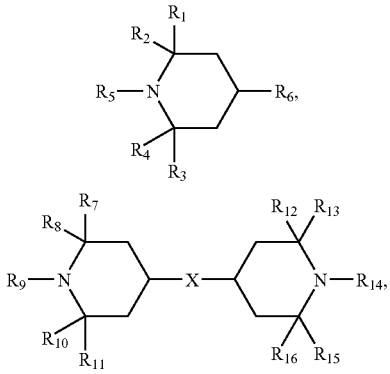

where $R_1$, $R_2$, $R_3$, $R_4$, $R_6$, $R_7$, $R_8$, $R_{10}$, $R_{11}$, $R_{12}$, $R_{13}$, $R_{14}$, $R_{15}$ are independently, hydrogen, alkyl group, or ester, or ether group; and $R_5$, $R_9$, and $R_{14}$ are, independently, alkyl group; and X is a linking group selected from the group consisting of —O—CO—$(CH_2)_m$—CO—O— where m is between 2 to 20.

There are many kinds of charge transport compounds available for electrophotography. For example, any charge transport compound known in the art can be used to form organophotoconductors described herein. Suitable charge transport compounds include, but are not limited to, pyrazoline derivatives, fluorene derivatives, oxadiazole derivatives, stilbene derivatives, hydrazone derivatives, carbazole hydrazone derivatives, triaryl amines, polyvinyl carbazole, polyvinyl pyrene, polyacenaphthylene, or multi-hydrazone compounds comprising at least two hydrazone groups and at least two groups selected from the group consisting of triphenylamine and heterocycles such as carbazole, julolidine, phenothiazine, phenazine, phenoxazine, phenoxathiin, thiazole, oxazole, isoxazole, dibenzo(1,4)dioxine, thianthrene, imidazole, benzothiazole, benzotriazole, benzoxazole, benzimidazole, quinoline, isoquinoline, quinoxaline, indole, indazole, pyrrole, purine, pyridine, pyridazine, pyrimidine, pyrazine, triazole, oxadiazole, tetrazole, thiadiazole, benzisoxazole, benzisothiazole, dibenzofuran, dibenzothiophene, thiophene, thianaphthene, quinazoline, cinnoline or combinations thereof. In some embodiments, the charge transport compound is an enamine stilbene compound such as MPCT-10, MPCT-38, and MPCT-46 from Mitsubishi Paper Mills (Tokyo, Japan).

The polymer binder for any of the particular layers of the organophotoreceptor generally is capable of dispersing or dissolving the corresponding functional compounds, such as the electron transport composition, the charge transport compound, the charge generating compound and the UV light stabilizing compound. Examples of suitable polymer binders generally include, for example, polystyrene-co-butadiene, polystyrene-co-acrylonitrile, modified acrylic polymers, polyvinyl acetate, styrene-alkyd resins, soya-alkyl resins, polyvinylchloride, polyvinylidene chloride, polyacrylonitrile, polycarbonates, polyacrylic acid, polyacrylates, polymethacrylates, styrene polymers, polyvinyl butyral, alkyd resins, polyamides, polyurethanes, polyesters, polysulfones, polyethers, polyketones, phenoxy resins, epoxy resins, silicone resins, polysiloxanes, poly(hydroxyether) resins, polyhydroxystyrene resins, novolak, poly(phenylglycidyl ether)-co-dicyclopentadiene, copolymers of monomers used in the above-mentioned polymers, and combinations thereof. In some embodiments of particular interest, the binder is selected from the group consisting of polycarbonates, polyvinyl butyral, and a combination thereof. Examples of suitable polycarbonate binders include polycarbonate A which is derived from bisphenol-A, polycarbonate Z, which is derived from cyclohexylidene bisphenol, polycarbonate C, which is derived from methylbisphenol A, and polyestercarbonates. Examples of suitable of polyvinyl butyral are BX-1 and BX-5 form Sekisui Chemical Co. Ltd., Japan. For a release layer, it may be desirable for the polymer to be, for example, a fluorinated polymer, siloxane polymer, fluorosilicone polymer, polysilane, polyethylene, polypropylene, polyacrylate, poly(methyl methacrylate-co-methacrylic acid), urethane resins, urethane-epoxy resins, acrylated-urethane resins, urethane-acrylic resins, crosslinked polymers thereof or a combination thereof.

Suitable optional additives for any one or more of the layers include, for example, antioxidants, coupling agents, dispersing agents, curing agents, surfactants and combinations thereof.

The photoconductive element overall typically has an average thickness of from about 10 to about 45 microns. Generally, the total average thickness of the photoconductive layer or layers can be from about 0.5 microns to about 40 microns and in some embodiments from about 2 microns to about 20 microns. For embodiments with two photoconductive layers, the total average thickness of the inner photoconductive layer, i.e., the layer closer to the electrically conductive substrate, and the outer photoconductive layer is from about 0.5 microns to about 40 microns, in some embodiments from about 1 micron to about 30 microns and in further embodiments from about 2 microns to about 20 microns. The thickness ratio of the outer to the inner photoconductive layer can vary from 1/20 to 3/1, and in further embodiments from about 1/15 to 2/1. A person of ordinary skill in the art will recognize that additional ranges of thickness and thickness ratios within the explicit ranges above are contemplated and are within the present disclosure.

In embodiments having a separate charge transport layer, the charge transport layer generally has an average thickness from about 5 microns to about 35 microns. For these embodiments, the total average thickness of the photoconductive layer(s) generally has a thickness form about 0.5 to about 4 microns. In embodiments in which a charge transport compound and a charge generating compound are combined within a photoconductive layer, the photoconductive layer generally has an average thickness from about 7 to about 30 microns. In embodiments with a separate electron transport layer, the electron transport layer generally can have an average thickness from about 0.5 microns to about 10 microns and in further embodiments from about 1 micron to about 3 microns. The electron transport layer generally can increase mechanical abrasion resistance, increases resistance to carrier liquid and atmospheric moisture, and decreases degradation of the photoreceptor by corona gasses. A person of ordinary skill in the art will recognize that additional ranges of thickness within the explicit ranges above are contemplated and are within the present disclosure.

The photoconductive element, including each photoconductive layer, may be formed, for example, in accordance with any conventional technique known in the art, such as dip coating, spray coating, extrusion and the like. Conveniently, a photoconductive layer may be formed by dispersing or dissolving the components such as a charge generating compound, a charge transport compound, a light stabilizer, an electron transport compound, and a polymeric binder in organic solvent, coating the dispersion and/or solution on the respective underlying layer and drying the coating. In some embodiments, the components are dispersed by high shear homogenization, ball-milling, attritor milling, high energy bead (sand) milling or other size reduction processes or mixing means known in the art for effecting particle size reduction in forming a dispersion.

For embodiments with a photoconductive layer without a charge transport compound or an electron transport compound, the photoconductive layer generally comprises a binder in an amount from about 10 to about 90 weight percent and in some embodiments in an amount of from about 20 to about 75 weight percent, based on the weight of the photoconductive layer. The remaining portion of the layer comprises one or more charge generating compounds, although a small portion of the mass can be optional additives. In alternative embodiments, the photoconductive layer also comprises an optional electron transport compound. In a photoconductive layer comprising a charge generating compound and an electron transport compound, the electron transport compound generally can be in an amount of at least about 2.5 weight percent, in further embodiments from about 4 to about 30 weight percent and in other embodiments in an amount from about 10 to about 25 weight percent, based on the weight of the photoconductive layer. A person of ordinary skill in the art will recognize that additional ranges of binder concentrations for the dual layer embodiments within the explicit ranges above are contemplated and are within the present disclosure.

For embodiments with a photoconductive layer comprising a charge transport compound, the charge generation compound can be in an amount of from about 0.05 to about 25 weight percent and in further embodiments in an amount of from about 2 to about 15 weight percent, based on the weight of the photoconductive layer. The charge transport compound can be in an amount from about 15 to about 80 weight percent, in other embodiments from about 25 to about 65 weight percent and in further embodiments in an amount of from about 30 to about 55 weight percent, based on the weight of the photoconductive layer, with the remainder of the photoconductive layer comprising the binder, and optionally additives, such as any conventional additives. Specifically, the photoconductive layer generally comprises a binder in an amount from about 10 weight percent to about 75 weight percent, and in further embodiments from about 25 weight percent to about 60 weight percent. Optionally, the photoconductive layer with the charge transport compound may also comprise an electron transport compound. The optional electron transport compound, if present, generally can be in an amount of at least about 2.5 weight percent, in further embodiments from about 4 to about 30 weight percent and in other embodiments in an amount from about 10 to about 25 weight percent, based on the weight of the photoconductive layer. A person of ordinary skill in the art will recognize that additional composition ranges within the explicit compositions ranges for the layers above are contemplated and are within the present disclosure.

For a specific embodiment with two photoconductive layers, the layer closer to the electrically conductive substrate can be referred to as the inner photoconductive layer and the layer further from the electrically conductive substrate can be referred to as the outer photoconductive substrate. The inner photoconductive layer can comprise the charge generation compound in an amount of from about 0.5 to about 25 weight percent and in further embodiments in an amount of from about 2 to about 10 weight percent, based on the weight of the photoconductive layer. For appropriate embodiments, the inner photoconductive layer can comprise a charge transport compound is in an amount of from about 15 to about 80 weight percent, based on the weight of the photoconductive layer, and in further embodiments in an amount of from about 30 to about 60 weight percent, based on the weight of the photoconductive layer. The binder can be in an amount of from about 15 to about 45 weight percent, based on the weight of the photoconductive layer, and in further embodiments in an amount of from about 20 to about 40 weight percent, based on the weight of the photoconductive layer. Optionally, the inner photoconductive layer may contain any additives, such as conventional additives.

For the outer photoconductive layer, the charge generation compound can be in an amount of from about 0.5 to about 25 weight percent and in further embodiments in an amount of from about 2 to about 15 weight percent, based on the weight of the photoconductive layer. The charge transport compound can be in an amount of from about 0 to about 45 weight percent, based on the weight of the photoconductive layer, and in further embodiments in an amount of from about 0.5 to about 20 weight percent, based on the weight of the photoconductive layer. The binder can be in an amount of from about 45 to about 99 weight percent, based on the weight of the photoconductive layer, and in further embodiments in an amount of from about 65 to about 99 weight percent, based on the weight of the photoconductive layer. Optionally, the photoconductive layer may contain any additives, such as conventional additives.

In addition, for some embodiments, the electron transport compound in the inner photoconductive layer can be in an amount of from about 0 to about 30 weight percent and in further embodiments in an amount of from about 1 to about 20 weight percent, based on the weight of the photoconductive layer. The electron transport compound in the outer photoconductive layer can be in an amount of from about 0 to about 50 weight percent and in further embodiments in an amount of from about 0.1 to about 20 weight percent, based on the weight of the photoconductive layer.

For a photoconductive layer with a composition gradient, the photoconductive layer can comprise, for example, a charge generating compound, an optional charge transport compound, an optional electron transport compound and any other optional additive, generally within a polymer binder. The composition gradient can be with respect to a single composition or a plurality of compositions. In particular, for some embodiments, it may be desirable to have a gradient in the concentration of a charge transport compound with a higher concentration at the inner portion of the layer and a lower concentration at the outer portion of the layer. Furthermore, it may be desirable to have a concentration of charge transport composition of no more than about 80 weight percent at the inner portion and in other embodiments from about 15 to about 60 weight percent at the inner portion. Also, it may be desirable to have a concentration of charge transport compound of about 0.1 at the outer portion or in further embodiments a concentration of about 1 to about 45 weight percent at the outer portion. In additional embodiments, it may be desirable to have a gradient in concentration of a charge generating compound with a larger concentration at the outer portion and a smaller concentration at the inner portion. In particular, in some embodiments, the gradient layer has a concentration of charge generating compound at the outer surface of about 0.5 to about 25 weight percent and in further embodiments from about 1 to about 20 weight percent. Similarly, the gradient photoconducting layer can have a concentration of charge generating compound at the inner surface of about 0.5 to about 10 weight percent and in additional embodiments from about 1 to about 5 weight percent. A person of ordinary skill in the art will recognize that additional ranges within these explicit ranges of concentration are contemplated and are within the present disclosure. While mathematically, a gradient can involve a continuous change, in physical systems molecular dimensions provide real limits on the variation and practical limits on gradient measurements that provide additional constraints. For practical purposes, any variation in concentration on a scale of 100 nanometers or less can be considered a continuous variation in concentration. Layers with an approximately uniform average chemical composition over an average thickness of at least about 100 nm is referred herein to a discrete layer, in contrast with a layer forming a portion of a gradient.

A charge transport layer generally comprises a binder in an amount from about 30 weight percent to about 70 weight percent with the charge transport compound making up the remaining weight except for any optional additives generally in relatively minor amounts. An electron transport layer generally can comprise an electron transport compound, an optional UV light stabilizer and a binder. The electron transport compound in an electron transport layer can be in an amount from about 10 to about 50 weight percent, and in other embodiments in an amount from about 20 to about 40 weight percent, based on the weight of the electron transport layer. The UV light stabilizer in each of one or more appropriate layers of the photoconductive element, such as a photoconductive layer and/or an electron transport layer, generally is in an amount from about 0.5 to about 25 weight percent and in some embodiments in an amount from about 1 to about 10 weight percent, based on the weight of the particular layer. A person of ordinary skill in the art will recognize that additional ranges of compositions within the explicit ranges are contemplated and are within the present disclosure. An overcoat layer comprising an electron transport compound is described further in copending U.S. patent application Ser. No. 10/396,536 to Zhu et al. entitled, "Organoreceptor With An Electron Transport Layer," incorporated herein by reference.

A release layer or a protective layer may contain an electron transport compound. Any electron transport compound known in the art may be used in the release layer or the protective layer, such as those described above. The electron transport compound in the release layer or the protective layer generally can be in an amount of from about 2 to about 50 weight percent and in further embodiments in an amount of from about 10 to about 40 weight percent, based on the weight of the release layer or the protective layer. A person of ordinary skill in the art will recognize that additional ranges of composition within the explicit ranges are contemplated and are within the present disclosure. While an overcoat layer may or may not have an electron transport composition, the presence of an electron transport composition in each overcoat layer (which may or may not be the same composition as in other overcoat layers) can provide continuity of electrical conductivity between a charge generating layer and the surface, which may improve the performance of the organophotoreceptor.

The organophotoreceptor may optionally have additional layers as well, which do not generally comprise a charge generating compound, a charge transport compound or an electron transport compound. Such additional layers can be, for example, a sub-layer, an intermediate layer and/or an overcoat layer. The sub-layer can be a charge blocking layer and locates between the electrically conductive substrate and the photoconductive element. The sub-layer may also improve the adhesion between the electrically conductive substrate and the photoconductive element. An intermediate layer generally is a barrier layer or an adhesive layer.

Overcoat layers can be, for example, barrier layers, release layers, protective layers, and adhesive layers. With respect to overcoat layers, the photoreceptor can comprise a plurality of overcoat layers having an electron transport composition. For example, the release layer or the protective layer may contain an electron transport compound. One or more of the electron transport compounds described above may be used in the release layer or the protective layer.

A release layer or a protective layer can form the uppermost layer of the photoconductor layer. A release layer is a top layer that facilitates the transfer of toner from the organophotoreceptor to an intermediate transfer medium, such as a belt or drum, or to a receiving medium, such as paper, when the toner transfer is not facilitated by electrostatic forces or magnetic forces. A release layer can have a lower surface energy than the surface energy of the medium to which the toner is transferred from the organophotoreceptor. The barrier layer may be sandwiched between the release layer and the photoconductive element or used to overcoat the photoconductive element. The barrier layer provides protection for abrasion and solvent resistance to the underlayers. A protective layer is a top layer that provides protection for abrasion and solvent resistance to the underlayers. A layer can be both a protective layer and a release layer. An adhesive layer locates and improves the adhesion between adjacent layers, such as between a photoconductive layer and an overcoat layer, between two photoconductive layers or between two overcoat layers.

Suitable barrier layers include, for example, coatings such as crosslinkable siloxanol-colloidal silica coating and hydroxylated silsesquioxane-colloidal silica coating, and organic binders such as polyvinyl alcohol, methyl vinyl ether/maleic anhydride copolymer, casein, polyvinyl pyrrolidone, polyacrylic acid, gelatin, starch, polyurethanes, polyimides, polyesters, polyamides, polyvinyl acetate, polyvinyl chloride, polyvinylidene chloride, polycarbonates, polyvinyl butyral, polyvinyl acetoacetal, polyvinyl formal, polyacrylonitrile, polymethyl methacrylate, polyacrylates, polyvinyl carbazoles, copolymers of monomers used in the above-mentioned polymers, vinyl chloride/vinyl acetate/vinyl alcohol terpolymers, vinyl chloride/vinyl acetate/maleic acid terpolymers, ethylene/vinyl acetate copolymers, vinyl chloride/vinylidene chloride copolymers, cellulose polymers, and mixtures thereof. The above barrier layer polymers optionally may contain small inorganic particles such as fumed silica, silica, titania, alumina, zirconia, or a combination thereof. Barrier layers are described further in U.S. Pat. No. 6,001,522 to Woo et al., entitled Barrier Layer For Photoconductor Elements Comprising An Organic Polymer And Silica," incorporated herein by reference.

The release layer may comprise, for example, any release layer composition known in the art. In some embodiments, the release layer is a fluorinated polymer, siloxane polymer, fluorosilicone polymer, polysilane, polyethylene, polypropylene, polyacrylate, poly(methyl methacrylate-co-methacrylic acid), urethane resins, urethane-epoxy resins, acrylated-urethane resins, urethane-acrylic resins, or a combination thereof. The release layers can comprise crosslinked polymers.

The protective layer protects the organophotoreceptor from chemical and mechanical degradation. The protective layer may comprise, for example, any protective layer composition known in the art. Preferably, the protective layer is a fluorinated polymer, siloxane polymer, fluorosilicone polymer, silane, polyethylene, polypropylene, polyacrylate, poly(methyl methacrylate-co-methacrylic acid), urethane resins, urethane-epoxy resins, acrylated-urethane resins, urethane-acrylic resins, or a combination thereof. In some embodiments, the protective layer comprises crosslinked polymers.

Generally, adhesive layers comprise a film forming polymer, such as polyester, polyvinylbutyral, polyvinylpyrolidone, polyurethane, polymethyl methacrylate, poly(hydroxy amino ether), combinations thereof and the like. Overcoat layers are described further in U.S. Pat. No. 6,180,305 to Ackley et al., entitled "Organic Photoreceptors For Liquid Electrophotography," incorporated herein by reference.

Sub-layers can comprise, for example, polyvinylbutyral, organosilanes, hydrolyzable silanes, epoxy resins, polyesters, polyamides, polyurethanes, silicones, combinations thereof and the like. In some embodiments, the sub-layer has a dry thickness between about 20 Angstroms and about 2,000 Angstroms. Sublayers containing metal oxide conductive particles can be 1–25 microns thick. A person of ordinary skill in the art will recognize that additional ranges of compositions and thickness within the explicit ranges are contemplated and are within the present disclosure.

The organophotoreceptors as described herein are suitable for use in an imaging process with either dry or liquid toner development including, for example, dry toners and liquid toners known in the art. Liquid toner development can be desirable because it offers the advantages of providing higher resolution images and requiring lower energy for image fixing compared to dry toners. Examples of suitable liquid toners are known in the art. Liquid toners generally comprise toner particles dispersed in a carrier liquid. The toner particles generally can comprise a colorant/pigment, a resin binder, and/or a charge director. In some embodiments of liquid toner, a resin to pigment ratio can be from 1:1 to 10:1, and in other embodiments, from 4:1 to 8:1. Liquid toners are described further in Published U.S. Patent Applications 2002/0128349, entitled "Liquid Inks Comprising A Stable Organosol," 2002/0086916, entitled "Liquid Inks Comprising Treated Colorant Particles," and 2002/0197552, entitled "Phase Change Developer For Liquid Electrophotography," all three of which are incorporated herein by reference.

Organophotoreceptor (OPR) Preparation Methods

Conveniently, the photoconductive element may be formed by dispersing or dissolving the components, such as a charge generating compound, a charge transport compound, a light stabilizer, an electron transport compound, and/or a polymeric binder in organic solvent, coating the dispersion and/or solution on the respective underlying layer and drying the coating. In some embodiments, the components can be dispersed by high shear homogenization, ball-milling, attritor milling, high energy bead (sand) milling or other size reduction processes or mixing means known in the art for effecting particle size reduction in forming a dispersion. The coatings can be applied, for example, using knife coating, extrusion, dip coating or other appropriate coating approaches, including those known in the art. In some embodiments, a plurality of layers are applied as sequential coatings. The layers can be dried prior to the application of a subsequent layer. Some specific examples of applying an organophotoreceptor are presented below.

Furthermore, a gradient layer can be formed by adapting the above noted coating approaches. In particular, the coating approaches can be used to form very thin layers that are consecutively placed on the substrate with appropriately varying concentration changes in the coating solutions for different layers. Alternatively, a spray coating approach can be used, for example, with the feed to the spray coating apparatus being varied in time to produce the desired concentration gradient, which can be a continuous variation in concentration if the layer is deposited simultaneously over the entire substrate or with incremental concentration changes if the different portions of the layer are deposited as thin sublayers sequentially in time.

In addition, the composition gradient can be imposed after the polymer layers are formed. For example, the organophotoreceptor can be placed within a solution that does not dissolve the polymer binder while dissolving a compound to be drawn out from the organophotoreceptor as deposited. As the particular compound diffuses from the polymer binder, a gradient can be naturally established if the diffusion process is appropriately stopped before all or a substantial portion of the compound has diffused from the material. Similarly, a compound can be implanted within a polymer binder by contacting the polymer binder with a solution comprising the compound to be transferred to polymer binder. The diffusion process into the binder can naturally form a concentration gradient if the diffusion process is stopped before reaching equilibrium.

Performance Properties of the Organophotoreceptors with a Plurality of Photoconductive Layers The improved organophotoconductors with a plurality of photoconductive layers can have improved cycling properties relative to organophotoreceptors with a single photoconductive layer. In particular, the improved organophotoreceptors can have improved performance parameters after cycling under either dry conditions and/or wet conditions. In particular, after 100 dry cycles, the organophotoreceptors can have a decrease in acceptance voltage ($V_{acc}$) of no more than about 25 volts and in further embodiments no more than about 20 volts relative to the initial acceptance voltage. Furthermore, after 100 dry cycles, the organophotoreceptors can simultaneously have a magnitude, i.e., absolute value, of change in discharge voltage ($V_{dis}$) of no more than about 20 volts, in further embodiments, no more than about 10 volts, and in other embodiments no more than about 5 volts relative to an initial discharge voltage. The dry cycling is performed as described below.

In addition, the organophotoreceptors with a plurality of photoconductive layers can have an improved performance following wet cycling relative to single photoconductive layer organophotoreceptors. Specifically, after 4000 wet cycles, the organophotoreceptors can have a decrease in acceptance voltage ($V_{acc}$) of no more than about 45 volts and in further embodiments no more than about 25 volts. Furthermore, the organophotoreceptors can have an increase in discharge voltage ($V_{dis}$) after 4000 wet cycles of no more than 125 volts and in further embodiment no more than about 110 volts. The wet cycling performance properties can be determined as described below.

The invention will now be described further by way of the following examples.

EXAMPLES

In the following examples, organophotoreceptors are formed with one or two photoconductive layers. In some embodiments, the photoconductive elements incorporates (4-n-butoxycarbonyl-9-fluorenylidene) malononitrile as an electron transport compound. The synthesis of this electron transport compound is described next.

Preparation of (4-n-Butoxycarbonyl-9-fluorenylidene)Malononitrile

A 460 g quantity of concentrated sulfuric acid (4.7 moles, analytical grade, commercially obtained from Sigma-Aldrich, Milwaukee, Wis.) and 100 g of diphenic acid (0.41 mole, commercially obtained from Acros Fisher Scientific Company Inc., Hanover Park, Ill.) were added to a 1-liter 3-neck round bottom flask, equipped with a thermometer, mechanical stirrer and a reflux condenser. Using a heating mantle, the flask was heated to 135–145° C. for 12 minutes, and then cooled to room temperature. After cooling to room temperature, the solution was added to a 4-liter Erlenmeyer flask containing 3 liter of water. The mixture was stirred mechanically and was boiled gently for one hour. A yellow solid was filtered out hot, washed with hot water until the pH of the wash-water was neutral, and was air-dried overnight. The yellow solid was fluorenone-4-carboxylic acid. The yield was 75 g (80%). The product was then characterized. The melting point (m.p.) was found to be 223–224° C. A $^1$H-NMR spectrum of fluorenone-4-carboxylic acid was obtained in $d_6$-DMSO solvent with a 300 MHz NMR from Bruker Instrument. The peaks were found at (ppm) δ=7.39–7.50 (m, 2H); δ=7.79–7.70 (q, 2H); δ=7.74–7.85 (d, 1H); δ=7.88–8.00 (d, 1H); and δ=8.18–8.30 (d, 1H), where d is doublet, t is triplet, m is multiplet, dd is double doublet, and q is quintet.

A 70 g (0.312 mole) quantity of fluorenone-4-carboxylic acid, 480 g (6.5 mole) of n-Butanol (commercially obtained from Fisher Scientific Company Inc., Hanover Park, Ill.), 1000 ml of Toluene and 4 ml of concentrated sulfuric acid were added to a 2-liter round bottom flask equipped with a mechanical stirrer and a reflux condenser with a Dean Stark apparatus. With aggressive agitation and refluxing, the solution was refluxed for 5 hours, during which ~6 g of water were collected in the Dean Stark apparatus. The flask was cooled to room temperature. The solvents were evaporated and the residue was added, with agitation, to 4-liter of a 3% sodium bicarbonate aqueous solution. The solid was filtered off, washed with water until the pH of the wash-water was neutral, and dried in the hood overnight. The product was n-butyl fluorenone-4-carboxylate ester. The yield was 70 g (80%). A $^1$H-NMR spectrum of n-butyl fluorenone-4-carboxylate ester was obtained in $CDCl_3$ with a 300 MHz NMR from Bruker Instrument. The peaks were found at (ppm) δ=0.87–1.09 (t, 3H); δ=1.42–1.70 (m, 2H); δ=1.75–1.88 (q, 2H); δ=4.26–4.64 (t, 2H); δ=7.29–7.45 (m, 2H); δ=7.46–7.58 (m, 1H); δ=7.60–7.68 (dd, 1H); δ=7.75–7.82 (dd, 1H); δ=7.90–8.00 (dd, 1H); and δ=8.25–8.35 (dd, 1H).

A 70 g (0.25 mole) quantity of n-butyl fluorenone-4-carboxylate ester, 750 ml of absolute methanol, 37 g (0.55 mole) of malononitrile (commercially obtained from Sigma-Aldrich, Milwaukee, Wis.), 20 drops of piperidine (commercially obtained from Sigma-Aldrich, Milwaukee, Wis.) were added to a 2-liter, 3-neck round bottom flask equipped with a mechanical stirrer and a reflux condenser. The solution was refluxed for 8 hours, and the flask was cooled to room temperature. The orange crude product was filtered, washed twice with 70 ml of methanol and once with 150 ml of water, and dried overnight in a hood. This orange crude product was recrystalized from a mixture of 600 ml of acetone and 300 ml of methanol using activated charcoal. The flask was placed at 0° C. for 16 hours. The crystals were filtered and dried in a vacuum oven at 50° C. for 6 hours to obtain 60 g of pure (4-n-butoxycarbonyl-9-fluorenylidene) malononitrile. The melting point (m.p.) of the solid was found to be 99–100° C. A $^1$H-NMR spectrum of (4-n-butoxycarbonyl-9-fluorenylidene) malononitrile was obtained in $CDCl_3$ with a 300 MHz NMR from Bruker Instrument. The peaks were found at (ppm) δ=0.74–1.16 (t, 3H); δ=1.38–1.72 (m, 2H); δ=1.70–1.90 (q, 2H); δ=4.29–4.55 (t, 2H); δ=7.31–7.43 (m, 2H); δ=7.45–7.58 (m, 1H); δ=7.81–7.91 (dd, 1H); δ=8.15–8.25 (dd, 1H); δ=8.42–8.52 (dd, 1H); and δ=8.56–8.66 (dd, 1H).

Example 1

Preparation of Organophotoreceptors

This example describes the preparation of four organophotoreceptors with an inner photoconductive layer and an outer photoconductive layer. Also, four comparative samples are described with a single photoconductive layer and for three comparative samples an overcoat layer.

Comparative Sample A

Comparative Sample A was a single layer organophotoreceptor having a 76.2 micron (3 mil) thick polyester substrate with a layer of vapor-coated aluminum (commercially obtained from CP Films, Martinsville, Va.). The coating solution for the single layer organophotoreceptor was prepared by pre-mixing 2.4 g of 20 weight % (4-n-butoxycarbonyl-9-fluorenylidene) malononitrile (prepared in the lab as described above) dissolved in tetrahydrofuran (commercially obtained from Aldrich, Milwaukee, Wis.), 6.7 g of 25 weight % MPCT-10 (a charge transfer material, commercially obtained from Mitsubishi Paper Mills, Tokyo, Japan) dissolved in tetrahydrofuran, 5.7 g of 14 weight % polyvinyl butyral resins (BX-1, commercially obtained from Sekisui Chemical Co. Ltd., Japan) dissolved in tetrahydrofuran, 0.43 g of 5 weight % Tinuvin-292 and 0.35 g of 5 weight % Tinuvin-928 (both commercially available from Ciba Specialty Chemicals, Inc., Terrytown, N.Y.) dissolved in tetrahydrofuran, and 2.5 g of tetrahydrofuran. A 0.74 g quantity of a CGM mill-base containing 19 weight % of titanyl oxyphthalocyanine (commercially obtained from H.W. Sands Corp., Jupiter, Fla.) and a polyvinyl butyral resin (BX-5, commercially obtained from Sekisui Chemical Co. Ltd., Japan) at a weight ratio of 2.3:1 was then added to the above mixture. The CGM mill-base was obtained by milling 112.7 g of the titanyl oxyphthalocyanine (H.W. Sands Corp., Jupiter, Fla.) with 49 g of the polyvinyl butyral resin (BX-5) in 651 g of methylethylketone on a horizontal sand mill (model LMC12 DCMS, commercially obtained from Netzsch Incorporated, Exton, Pa.) with 1-micron zirconium beads using recycle mode for 4 hours. After mixing on a mechanical shaker for about 1 hour, the single layer coating solution was coated onto the substrate described above using a knife coater with a gap space of 94 micron followed by drying in an oven at 110° C. for 5 minutes.

Comparative Sample B

Comparative Sample B consists of an outer layer that was coated on top of Comparative Sample A, which became the inner photoconductive layer. The outer photoconductive layer was prepared by dissolving 0.5 g of B-72 (a polyvinyl butyral resin, commercially obtained from Solutia, St Louis, Mo.) in 10 g of tetrahydrofuran and then coating the solution onto the substrate of Comparative Sample A by using a knife coater with a gap space of 40 micron followed by drying in an oven at 95° C. for 5 minutes.

Comparative Sample C

Comparative Sample C was prepared similarly to Comparative Sample B except that the coating solutions were prepared by mixing 1 g of 5% (4-n-butoxycarbonyl-9-fluorenylidene) malononitrile (prepared in the lab as described above) dissolved in tetrahydrofuran and 9 g of B-72 (a polyvinyl butyral resin, commercially obtained from Solutia, St Louis, Mo.) dissolved in tetrahydrofuran.

Comparative Sample D

Comparative Sample D was prepared similarly to Comparative Sample B except that the coating solutions were prepared by mixing 2 g of 5% MPCT-10 (a charge transfer material, commercially obtained from Mitsubishi Paper Mills, Tokyo, Japan) dissolved in tetrahydrofuran and 8 g of B-72 (a polyvinyl butyral resin, commercially obtained from Solutia, St Louis, Mo.).

Sample 1

Sample 1 was prepared similarly to Comparative Sample B except that the coating solutions were prepared by mixing 0.39 g of a CGM mill-base described in the Comparative Sample A, 8.6 g of B-72 (a polyvinyl butyral resin, commercially obtained from Solutia, St Louis, Mo.), and 1.0 g of tetrahydrofuran. Note that the resulting outer photoconductive layer comprised about 0.8 weight percent charge generating compound, which compared with about 4.5 weight percent charge transport compound in the inner photoconductive layer.

Sample 2

Sample 2 was prepared similarly to Sample 1 except that the coating solutions were prepared by mixing 0.77 g of a CGM mill-base described in the Comparative Sample A, 2.0 g of 5% MPCT-10 (a charge transfer material, commercially obtained from Mitsubishi Paper Mills, Tokyo, Japan) dissolved in tetrahydrofuran, 5.13 g of B-72 (a polyvinyl butyral resin, commercially obtained from Solutia, St Louis, Mo.), 2.1 g of tetrahydrofuran.

Sample 3

Sample 3 were prepared similarly to Sample 1 except that the coating solutions were prepared by mixing 0.19 g of a CGM mill-base described in the Comparative Sample A, 0.5 g of 5% (4-n-butoxycarbonyl-9-fluorenylidene) malononitrile (prepared in the lab as described above) dissolved in tetrahydrofuran, 8.8 g of B-72 (a polyvinyl butyral resin, commercially obtained from Solutia, St Louis, Mo.), 0.5 g of tetrahydrofuran.

Sample 4

Sample 4 was prepared similarly to Sample 1 except that the coating solutions were prepared by mixing 0.39 g of a CGM mill-base described in the Comparative Sample A, 1.0 g of 5% MPCT-10 (a charge transfer material, commercially obtained from Mitsubishi Paper Mills, Tokyo, Japan) dissolved in tetrahydrofuran, 0.5 g of 5% (4-n-butoxycarbonyl-9-fluorenylidene) malononitrile (prepared in the lab as described above) dissolved in tetrahydrofuran, 7.1 g of B-72 (a polyvinyl butyral resin, commercially obtained from Solutia, St Louis, Mo.), 1.0 g of tetrahydrofuran.

Example 2

Soak Test

This example is directed to evaluating the resistance of the organphotoreceptors to solvents. Two circular pieces with a 30 mm diameter from each sample were cut by using an arch punch (commercially obtained from McMaster-Carr, Chicago, Ill.). After cutting, the circular pieces were soaked in 20 g of Norpar™ 12 (a hydrocarbon fluid with a high normal paraffin content commercially available from EXXONMOBILE) for 24 hours in a glass jar. The color change in the Norpar™ 12 solution after 24 hours of soaking was noticed and rated as light or dark yellow, which respectively means small or large amounts of extractible ingredients coming out of the coatings.

Example 3

Dry Electrostatic Testing

This example provides results of dry electrostatic testing on the organophotoreceptor samples formed as described in Example 2.

Extended electrostatic cycling performance of organophotoreceptors described herein can be determined using in-house designed and developed test bed that can test, for example, up to three sample strips wrapped around a drum. The results on these samples are indicative of results that would be obtained with other support structures, such as belts, drums and the like, for supporting the organophotoreceptors.

For testing using a 160 mm drum, three coated sample strips, each measuring 50 cm long by 8.8 cm wide, were fastened side-by-side and completely around an aluminum drum (50.3 cm circumference). In some embodiments, at least one of the strips is a comparative sample prepared with a charge transport compound (Compound 2 from U.S. Pat. No. 6,140,004, incorporated herein by reference) along with (4-n-butoxycarbonyl-9-fluorenylidene) malononitrile and the CGM mill-base in a binder, as described above for the single layer samples, that is precision web coated and used as an internal reference point. In this electrostatic cycling tester, the drum rotated at a rate of 8.13 cm/sec (3.2 ips), and the location of each station in the tester (distance and elapsed time per cycle) is given as shown in the following table:

TABLE 1

Electrostatic test stations around the 160 mm drum at 8.13 cm/sec.

| Station | Degrees | Total Distance, cm | Total Time, sec |
|---|---|---|---|
| Front erase bar edge | 0° | Initial, 0 cm | Initial, 0 s |
| Erase Bar | 0–7.2° | 0–1.0 | 0–0.12 |
| Scorotron Charger | 113.1–135.3° | 15.8–18.9 | 1.94–2.33 |
| Laser Strike | 161.0° | 22.5 | 2.77 |
| Probe #1 | 181.1° | 25.3 | 3.11 |
| Probe #2 | 251.2° | 35.1 | 4.32 |
| Erase bar | 360° | 50.3 | 6.19 |

The erase bar is an array of laser emitting diodes (LED) with a wavelength of 720 nm. that discharges the surface of the organophotoreceptor. The scorotron charger comprises a wire that permits the transfer of a desired amount of charge to the surface of the organophotoreceptor.

From the above table, the first electrostatic probe (TREK™ 344 electostatic meter, Trek, Inc. Medina, N.Y.) is located 0.34 s after the laser strike station and 0.78 s after the scorotron while the second probe (TREK™ 344 electrostatic meter) is located 1.21 s from the first probe and 1.99 s from the scorotron. All measurements are performed at ambient temperature and relative humidity.

Electrostatic measurements were obtained as a compilation of several runs on the test station. The first three diagnostic tests (prodtest initial, VlogE initial, dark decay initial) are designed to evaluate the electrostatic cycling of a new, fresh sample and the last three, identical diagnostic test (prodtest final, VlogE final, dark decay final) are run after cycling of the sample. In addition, measurements were made periodically during the test, as described under "longrun" below. The laser is operated at 780 nm wavelength, 600 dpi, 50 micron spot size, 60 nanoseconds/pixel expose time, 1,800 lines per second scan speed, and a 100% duty cycle. The duty cycle is the percent exposure of the pixel clock period, i.e., the laser is on for the full 60 nanoseconds per pixel at a 100% duty cycle.

Electrostatic Test Suite:

1) PRODTEST: Charge acceptance ($V_{acc}$) and discharge voltage ($V_{dis}$) were established by subjecting the samples to corona charging (erase bar always on) for three complete drum revolutions (laser off); discharged with the laser @ 780 nm & 600 dpi on the forth revolution (50 um spot size, expose 60 nanoseconds/pixel, run at a scan speed of 1,800 lines per second, and use a 100% duty cycle); completely charged for the next three revolutions (laser off); discharged with only the erase lamp @ 720 nm on the eighth revolution (corona and laser off) to obtain residual voltage ($V_{res}$); and, finally, completely charged for the last three revolutions (laser off). The contrast voltage ($V_{con}$) is the difference between $V_{acc}$ and $V_{dis}$, and the functional dark decay ($V_{dd}$) is the difference in charge acceptance potential measured by probes #1 and #2.

2) VLOGE: This test measures the photoinduced discharge of the photoconductor to various laser intensity levels by monitoring the discharge voltage of the sample as a function of the laser power (exposure duration of 50 ns) with fixed exposure times and constant initial potentials. This test measures the photoinduced discharge of the photoconductor to various laser intensity levels by monitoring the discharge voltage of the sample as a function of the laser power (exposure duration of 50 ns) with fixed exposure times and constant initial potentials. The functional photosensitivity, $S_{780\ nm}$, and operational power settings can be determined from this diagnostic test.

3) DARK DECAY: This test measures the loss of charge acceptance in the dark with time without laser or erase illumination for 90 seconds and can be used as an indicator of i) the injection of residual holes from the charge generation layer to the charge transport layer, ii) the thermal liberation of trapped charges, and iii) the injection of charge from the surface or aluminum ground plane.

4) LONGRUN: The sample was electrostatically cycled for 100 drum revolutions according to the following sequence per each sample-drum revolution. The sample was charged by the corona, the laser was cycled on and off (80–100° sections) to discharge a portion of the sample and, finally, the erase lamp discharged the whole sample in preparation for the next cycle. The laser was cycled so that the first section of the sample was never exposed, the second section was always exposed, the third section was never exposed, and the final section was always exposed. This pattern was repeated for a total of 100 drum revolutions, and the data was recorded periodically, after every 5th cycle.

5) After the LONGRUN test, the PRODTEST, VLOGE, DARK DECAY diagnostic tests were run again.

Table 2 shows the results from the prodtest initial and prodtest final diagnostic tests. The values for the charge acceptance voltage (Vacc, probe #1 average voltage obtained from the third cycle), discharge voltage (Vdis, probe #1 average voltage obtained from the fourth cycle) are reported for the initial and final cycles.

TABLE 2

Dry Electrostatic Testing Results After 100 Dry Cycles

| | Formulations[1] | | | | Prodtest Initial | | | | Differences After 100 dry cycles | | | Soak Test |
|---|---|---|---|---|---|---|---|---|---|---|---|---|
| Samples | CGM[2] | CTM[3] | ETM[4] | Binder[5] | $V_{acc}$ | $V_{dis}$ | $V_{con}$ | $V_{res}$ | $\Delta V_{acc}$ | $\Delta V_{dis}$ | $\Delta V_{res}$ | 24 hr |
| Comparative Sample A | See text | | | | 658 | 39 | 619 | 12 | 38 | −1 | −1 | Dark Yellow |
| Comparative Sample B | 0% | 0% | 0% | 100% | 743 | 380 | 363 | 283 | −45 | −4 | −32 | Light Yellow |
| Comparative Sample C | 0% | 0% | 10% | 90% | 710 | 333 | 377 | 247 | 0 | 73 | 31 | Light Yellow |
| Comparative Sample D | 0% | 20% | 0% | 80% | 710 | 351 | 359 | 286 | 9 | 74 | 34 | Light Yellow |
| Sample 1 | 10% | 0% | 0% | 90% | 701 | 49 | 652 | 14 | −24 | 0 | 0 | Light Yellow |
| Sample 2 | 20% | 20% | 0% | 60% | 684 | 73 | 611 | 19 | −18 | −16 | −5 | Dark Yellow |
| Sample 3 | 5% | 0% | 5% | 90% | 700 | 73 | 627 | 24 | −23 | 1 | −2 | Light Yellow |
| Sample 4 | 10% | 10% | 5% | 75% | 709 | 63 | 646 | 20 | −22 | −8 | −4 | Light Yellow |

Note:
[1]The amount of each ingredient was based on the total percent of solids by weight in the coating solutions.
[2]CGM is titanium oxyphthalocyanine.
[3]CTM is MPCT-10 commercially obtained from Mitsubishi Paper Mills.
[4]ETM is (4-n-Butoxycarbonyl-9-fluorenylidene) Malononitrile.
[5]Binder is B-72, a polyvinyl butyral resin commercially obtained from Solutia.

As can be seen from these results, samples with two photoconductive layers can be formed with relatively small drops in $\Delta V_{acc}$ and small changes in $\Delta V_{dis}$ after cycling 100 cycles. Thus, the sample exhibit improved performance relative to the comparative examples.

Example 4

Wet Electrostatic Testing

This example provides results of wet electrostatic testing on the organophotoreceptor samples formed as described in Example 2.

The wet cycling, electrostatic performance of the photoconductive element of this invention is determined using an in-house designed and developed test bed that tests up to 2 samples strips that are wrapped around a drum. The two coated sample strips, each measuring 47 cm long by 8.8 cm wide, are fastened side-by-side and held in-place by clamps that are built into the aluminum drum (50.48 cm circumference). One of the strips can be a control sample (e.g., Compound 2 in U.S. Pat. No. 6,140,004) that was precision web coated and used as an internal reference. In this electrostatic cycling tester, the drum rotated at a surface velocity of 14.7 cm/s (5.8 ips) and the location of each station in the tester (distance and elapsed time per cycle) is given as described in Table 3.

TABLE 3

Electrostatic test stations around the sample sheet wrapped drum.

| Station | Degrees | Total Distance, cm | Total Time, sec |
|---|---|---|---|
| Front erase bar edge | 0° | Initial, 0 cm | Initial, 0 s |
| Erase Bar | 0°–2.7° | 0–0.38 | 0–0.03 |
| Scorotron | 54.2°–72.7° | 7.6–10.2 | 0.52–0.69 |

TABLE 3-continued

Electrostatic test stations around the sample sheet wrapped drum.

| Station | Degrees | Total Distance, cm | Total Time, sec |
|---|---|---|---|
| Laser Strike | 113.4° | 15.9 | 1.08 |
| Probe #1 | 130.5° | 18.3 | 1.24 |
| Developer Station | 182.6° | 25.6 | 1.74 |
| Squeegee | 194.7° | 27.3 | 1.85 |
| Erase bar | 360° | 50.48 | 3.43 |

From the table, the first electrostatic probe (Trek 344 electrostatic meter) is located 0.16 s after the laser strike station and 0.64 s after the center of the scorotron. The developer station delivers Norpar™ 12 to wet the sample surface through the 6 mil gap between the bottom of the drum and the rotating developer roller. The squeegee roller is in contact with the drum and removes any excess liquid Norpar™ 12 from the sample surface. All measurements were performed at ambient temperature and relative humidity.

Electrostatic measurements were obtained as a compilation of several tests. The first three diagnostic tests (prodtest initial, VlogE initial, dark decay initial) are designed to evaluate the electrostatic properties of the sample at the beginning of the cycling. The last three, identical diagnostic tests (prodtest final, VlogE final, dark decay final) are run after cycling of the sample. These three initial and final diagnostic test sets are run with the developer station disengaged from the sample drum, i.e., under dry sample conditions. In addition, measurements were made periodically during the test, as described under "longrun" below.

1) PRODTEST: Charge acceptance ($V_{acc}$) and discharge voltage ($V_{dis}$) were established by subjecting the samples to corona charging (erase bar always on) for three complete drum revolutions (laser off); discharged with the laser @ 780 nm & 600 dpi on the forth revolution; completely charged for the next three revolutions (laser off); discharged with only the erase lamp @ 720 nm on the eighth revolution (corona and laser off) to obtain residual voltage ($V_{res}$); and, finally, completely charged for the last three revolutions (laser off). The contrast voltage ($V_{con}$) is the difference between $V_{acc}$ and $V_{dis}$.
2) VLOGE: This test measures the photoinduced discharge of the photoconductor to various laser intensity levels by monitoring the discharge voltage of the sample as a function of the laser power (exposure duration of 50 ns) with fixed exposure times and constant initial potentials. This test measures the photoinduced discharge voltage of the sample as a function of the laser power (exposure duration of 50 ns) with fixed exposure times and constant initial potentials.
3) DARK DECAY: This test measures the loss of charge acceptance with time without laser or erase illumination for 90 seconds and can be used as an indicator of i) the injection of residual holes from the charge generation layer to the charge transport layer, ii) the thermal liberation of trapped charges, and iii) the injection of charge from the surface or aluminum ground plane.
4) LONGRUN: The liquid ink developer station containing Norpar™ 12 is translated into position. The sample was electrostatically cycled for 4,000 drum revolutions according to the following sequence per each drum revolution. The sample was charged by the corona, the laser was cycled on and off (80–100° sections) to discharge a portion of the sample and, finally, the erase lamp discharged the whole sample in preparation for the next cycle. The laser was cycled so that the first section of the sample was never exposed, the second section was always exposed, and the third section was never exposed. This pattern was repeated for 4,000 drum revolutions and the data is recorded for every $200^{th}$ cycle.
5) After the 4,000th cycle (long run test), the PRODTEST, VLOGE, DARK DECAY diagnostic tests were run again without cycling with Norpar™ 12 to collect electrostatic results at the end of the cycling.

TABLE 4

Wet Electrostatic Results After 4000 Wet Cycles

| | Formulations | | | | Prodtest Initial | | | | Differences After 4000 Wet Cycles | | |
|---|---|---|---|---|---|---|---|---|---|---|---|
| Samples | CGM | CTM | ETM | Binder | $V_{acc}$ | $V_{dis}$ | $V_{con}$ | $V_{res}$ | $\Delta V_{acc}$ | $\Delta V_{dis}$ | $\Delta V_{res}$ |
| Comparative Sample A | See test | | | | 652 | 50 | 602 | 12 | −48 | 157 | 115 |
| Sample 1 | 10% | 0% | 0% | 90% | 679 | 59 | 620 | 21 | −40 | 123 | 62 |
| Sample 3 | 5% | 0% | 5% | 90% | 688 | 79 | 609 | 28 | −20 | 109 | 65 |

After wet cycling, the samples exhibited acceptable drops in the values for $V_{acc}$ and small increases of $V_{dis}$. Thus, the samples exhibited improved properties relative to comparative sample A with respect to both a smaller decrease in acceptance voltage and a very significantly smaller increase in discharge voltage.

As understood by those skilled in the art, additional substitution, variation among substituents, and alternative methods of synthesis and use may be practiced within the scope and intent of the present disclosure of the invention. The embodiments above are intended to be illustrative and not limiting. Additional embodiments are within the claims. Although the present invention has been described with reference to particular embodiments, workers skilled in the art will recognize that changes may be made in form and detail without departing from the spirit and scope of the invention.

What is claimed is:

1. An organophotoreceptor comprising an electrically conductive substrate having a surface; an inner photoconductive layer adjacent said surface; and an outer photoconductive layer adjacent said inner photoconductive layer with the inner photoconductive layer between the outer photoconductive layer and said electrically conductive substrate, wherein the composition of said inner photoconductive layer is different from the composition of said outer photoconductive layer; wherein said inner photoconductive layer comprises a first polymer binder and a first charge generating compound, and said outer photoconductive layer comprises a second polymer binder and a second charge generating compound; and wherein said inner photoconductive layer comprises no more than 45% by weight of said first polymer binder and said outer photoconductive layer comprises not less than 60% by weight of said second polymer binder, wherein said inner photoconductive layer and said outer photoconductive layer are portions of a gradient layer.

2. An organophotoreceptor according to claim 1 wherein said first polymer binder has the same composition as said second polymer binder.

3. An organophotoreceptor according to claim 2 wherein said first charge generating compound has the same chemical composition as said second charge generating compound.

4. An organophotoreceptor according to claim 1 wherein said organophotoreceptor is in the form of a drum.

5. An organophotoreceptor according to claim 1 wherein said inner photoconductive layer further comprises a first electron transport compound.

6. An organophotoreceptor according to claim 5 wherein said inner photoconductive layer further comprises a second electron transport compound.

7. An organophotoreceptor according to claim 1 wherein said outer photoconductive layer further comprises a electron transport compound.

8. An organophotoreceptor according to claim 1 wherein said inner photoconductive layer further comprises a UV stabilizer.

9. An organophotoreceptor according to claim 1 wherein said outer photoconductive layer further comprises a UV stabilizer.

10. An electrophotographic imaging apparatus comprising:

(a) a plurality of support rollers; and (b) an organophotoreceptor operably coupled to said support rollers with motion of said support rollers resulting in motion of said organophotoreceptor, said organophotoreceptor comprising: an electrically conductive substrate having a surface and an inner photoconductive layer adjacent said surface, and an outer photoconductive layer adjacent said inner photoconductive layer, wherein said inner photoconductive layer comprises a first polymer binder and a first charge generation compound and said outer photoconductive layer comprises a second polymer binder and a second charge generation compound, wherein said inner photoconductive layer has a different chemical composition from said outer photoconductive layer, and wherein said inner photoconductive layer comprises no more than 45% by weight of said first polymer binder and said outer photoconductive layer comprises not less than 60% by weight of said second polymer binder, wherein said inner photoconductive layer and said outer photoconductive layer are portions of a gradient layer.

11. An electrophotographic imaging apparatus according to claim 10 wherein said organophotoreceptor is in the form of a drum.

12. An electrophotographic imaging apparatus according to claim 10 wherein said inner photoconductive layer further comprises a first electron transport compound.

13. An electrophotographic imaging apparatus according to claim 12 wherein said outer photoconductive layer further comprises a second electron transport compound.

14. An electrophotographic imaging apparatus according to claim 10 wherein said outer photoconductive layer further comprises a charge transport compound.

15. An electrophotographic imaging apparatus according to claim 10 wherein said inner photoconductive layer further comprises a UV stabilizer.

16. An electrophotographic imaging apparatus according to claim 10 wherein said outer photoconductive layer further comprises a UV stabilizer.

17. An electrophotographic imaging apparatus according to claim 10 wherein said inner photoconductive layer and said outer photoconductive layer are discrete layers.

* * * * *